US006432602B1

(12) United States Patent
van Beek et al.

(10) Patent No.: US 6,432,602 B1
(45) Date of Patent: Aug. 13, 2002

(54) TRANSFER PRINTING PROCESS

(75) Inventors: Gary van Beek, North Gower; Randall Hayman, Nepean; Alan Boate, Gloucester, all of (CA)

(73) Assignee: Ait Advanced Information Technologies Corporation, Ottawa (CA)

( * ) Notice: Subject to any disclaimer, the term of this patent is extended or adjusted under 35 U.S.C. 154(b) by 0 days.

(21) Appl. No.: 09/344,539

(22) Filed: Jun. 25, 1999

(51) Int. Cl.[7] ..... G03G 13/16

(52) U.S. Cl. ..... 430/126; 430/10; 430/124; 156/240; 156/277; 156/289

(58) Field of Search ..... 430/10, 124, 126, 430/97; 156/230, 240, 241, 247, 277, 289

(56) References Cited

U.S. PATENT DOCUMENTS

| | | | | | |
|---|---|---|---|---|---|
| 4,006,050 | A | * | 2/1977 | Hurst et al. | 156/234 |
| 4,568,403 | A | * | 2/1986 | Egan | 156/247 |
| 4,917,748 | A | * | 4/1990 | Harrison | 156/230 |
| 5,073,218 | A | | 12/1991 | Aggio | |
| 5,871,837 | A | * | 2/1999 | Adair | 430/126 |
| 5,890,742 | A | | 4/1999 | Waller | |
| 5,973,710 | A | * | 10/1999 | Landman et al. | 430/48 |
| 6,017,636 | A | * | 1/2000 | Tada et al. | 428/423.1 |
| 6,299,719 | B1 | * | 10/2001 | Traband et al. | 156/241 |

FOREIGN PATENT DOCUMENTS

| | | | |
|---|---|---|---|
| EP | 0794466 | A2 * | 9/1997 |
| GB | 2 231 533 | | 9/1989 |
| GB | 2 273 466 | | 6/1994 |
| GB | 2 281 535 | | 3/1995 |
| WO | 96/32256 | | 10/1996 |
| WO | 97/31790 | | 9/1997 |

OTHER PUBLICATIONS

Grant, R et al, ed. Grant & Hackh's Chemical Dictionary, 5th ed., McGraw–Hill Book Co., NY (1987), p. 464.*

* cited by examiner

*Primary Examiner*—Janis L. Dote
(74) *Attorney, Agent, or Firm*—Robert A. Wilkes; Robert G. Hendry

(57) ABSTRACT

A transfer printing process is provided which both uses conventional equipment, and which can be used to add second level printing to an existing document such as a passport. All of the information to be applied in a second level printing procedure to a base sheet is assembled as a complete image. The image is printed in reverse, as a stable mirror image, onto the coated surface of a release paper by a conventional laser printer. The release paper carrying the reversed image and the base sheet are then placed into a heated press, with the image adjacent the base sheet. By the use of heat and pressure the image is transferred from the release paper onto the base sheet. The release paper is then removed, leaving the second level printed image on the base sheet.

11 Claims, No Drawings

TRANSFER PRINTING PROCESS

TECHNICAL FIELD OF THE INVENTION

This invention is concerned with a transfer printing process. More particularly, this invention is concerned with a transfer printing process of particular use in the preparation of security documents, such as passports and identity cards.

BACKGROUND OF THE INVENTION

On identity cards, passports and the like there are generally at least two levels of printing, which may also include features which are not normally visible to the unaided eye. In this context, "printing" is not limited to readable alphanumeric information, and includes any form of indicia which can be placed onto a surface of the document. The base sheet is often a so-called security paper, or may even be a synthetic paper-like sheet material other than paper, such a TESLIN (Trade Mark) sheet.

The first level of printing occurs when the base sheet for the document is prepared. This may involve background printing of, for example, a security pattern, the identity of the issuing agency, numerical data, a watermark, an encodable magnetic strip, and a holographic image. Further, some or all of this printed material may be applied to one or both sides of the base sheet.

The second level of printing occurs when personalised information identifying the person to whom the document is to be issued is applied to the base sheet. In the past this has usually involved text information, such as name, address, date of birth, a personal identification number, a document serial number, either of which may be in alphanumeric format or as a bar code, and date of issue. Although images of the holder have been used for many years in passports particularly, these have been in the form of a photograph as such, which has been attached in some way, usually by a gluing step, to the base sheet, which is often followed by a laminating step to protect the photographic image. In more recent practise, this pictorial information identifying the holder, such as a photograph or a fingerprint, is printed directly onto the base sheet, using computer based imaging systems.

Several techniques have been described both for preparing a base sheet carrying printed indicia at both levels, and for enhancing the inherent security of the resulting document. One example of this is the discontinuance of the use of a conventional photographic print which is attached in some way to the base sheet. Experience has shown that it is very difficult indeed to protect such a photograph adequately to prevent tampering with the document to alter it. However, although replacement of a photograph, and even all of the second level printing, by a computer generated image overcomes many of the recognised problems with the older methods of preparing security documents, it also has certain disadvantages. The chief problem is that in the printing techniques that have been used to date either a special printer is required, or an existing printer is significantly modified. In addition, a special printing technique is often used which has properties that are significantly different to the standard printing media, such as conventional printing ink and laser printer toners. One example of a special printing technique is the use of a laser which literally burns information into the document. Another example is described by Waller, in U.S. Pat. No. 5,890,742. In this process, the second level printing is applied directly onto a silicone coated surface of a transfer sheet. The printed release sheet is then positioned adjacent an adhesive layer on a security laminate, and transferred onto the adhesive layer. After removal of the transfer sheet, the security laminate is combined with a data receiving page carrying any desired first level printing. It can thus be seen that this is a complex process, which actually forms the second level printed image on the laminate, not the receiving page.

There is therefore a need for a document preparation process which both provides an acceptable level of security to the finished document, thus rendering it resistant to tampering and alteration, and which also only requires the use of standard printing equipment and printing techniques. Further, there is a need for such a process which additionally is able to print computer generated images including both pictorial information such as a photograph or fingerprint, and the more conventional alphanumeric information. This will allow the issuing authority to use current printing equipment meeting the standard requirements for document production with no more than a minimal level of adjustment.

Additionally, there is a need for a security document printing process which can be used to print material directly into a pre-prepared multi-page document, such as a passport, without using either a specially designed printer or any other special equipment. This need arises since conventional printing equipment uses single sheet (or roll) feed, and cannot print into a pre-prepared booklet, such as a passport. Although this difficulty can, to some extent, be avoided when the document is initially prepared, it cannot be avoided when additional information has to be added; a particular example is the addition of a printed visa to a passport.

SUMMARY OF THE INVENTION

This invention seeks to provide a process whereby the difficulties with the known process are effectively avoided. By the use of a transfer printing process, a printing process is provided which both uses conventional equipment, and which can be used to add second level printing to an existing document, especially a multi-page one such as a passport. With the process of this invention it is therefore possible to assemble the document, such as a passport, completely and to the highest security standards before any second level printing is included into it. Additionally, this printing process can readily be used to apply second level printing to both sides of the same base sheet. Further, in this process all of the printing equipment and materials used, particularly in producing the second level printed image, are standard commercially available equipment and materials requiring no modification.

In the process of this invention a multi-step procedure is used. Initially, all of the information to be applied in the second level printing procedure to the base sheet is assembled as a complete image, preferably using computer based imaging technology. The information can then be reviewed for both accuracy and completeness on a suitable screen. The image is then printed in reverse, as its mirror image, onto the silicone coated surface of a silicone release paper. The image can again be checked for accuracy and completeness. A conventional laser printer is used for this printing step. The release paper carrying the image and the base sheet are then placed into a heated press, with the image adjacent the base sheet. By the use of heat and pressure the image is transferred effectively completely from the silicone release surface onto the base sheet. After removal from the press, and allowing the document to cool, the release paper is removed, leaving the second level printed image on the base sheet.

Thus this invention seeks to provide a transfer printing process for applying an image to a document base sheet including the following steps:

(a) assembling the image;

(b) converting the image into its mirror image;

(c) printing the mirror image onto a silicone coated surface of a release substrate by means of a laser printer or photocopier to provide a stable toner particle copy of the mirror image;

(d) combining the release substrate and the base sheet, with the toner particle copy of the mirror image in contact with the base sheet;

(e) applying sufficient heat and pressure to the combined release substrate and the base sheet to transfer the toner mirror image onto the base sheet; and (f) removing the release substrate to provide a base sheet carrying the image.

Preferably, both image preparation and conversion in step (a) into its mirror image are carried out within a computer imaging system.

Preferably, a laser prister is used in step (c).

Preferably, a twin platen single sheet press in used in step (d), having one unheated platen, and one heated platen, and the base sheet is located adjacent the unheated platen. More preferably, a twin platen single sheet press is used in step (d), having one unheated platen, and one platen constructed and arranged to be both heated and cooled, and the base sheet is located adjacent the unheated platen.

Conveniently, the base sheet comprises one sheet of an existing document. Most conveniently, the base sheet comprises a sheet within a passport or equivalent multi-page document. Alternatively, the base sheet comprises the inside face of the cover page of a multi-page document.

Conveniently, in order to obtain as constant an applied pressure over the whole surface of the base sheet, a layer of deformable material, such as an elastomeric layer or cardboard, is located in the press between the base sheet and the unheated platen.

DETAILED DESCRIPTION OF THE INVENTION

In the following description, a passport is used as a typical document to which the process of this invention can be applied. However it is to be understood that the invention is not limited to multi-page documents with a comparatively stiff cover, and can be used with either single pages which are later assembled into a multi-page document, or with single page documents. Additionally, it is to be understood that the invention is not limited to creating a second level printed image on one side only of a sheet: it can be applied to both sides, by repeating the procedure for the second side.

In step (a) of the process, the information required to be in the second level printed image is assembled. Although this can be done by manual techniques, it is most convenient to prepare this image using computer imaging techniques. These are well known and do not require detailed description. The use of a computer imaging technique allows for the inclusion of both alphanumeric and pictorial information in the image. It is also possible to include other standard information within the image, such as, for example, the identity of the issuing agency.

In step (b) the assembled image is converted into its mirror image for printing in step (c). This conversion can be either left-to-right, or top-to-bottom. The conversion is required to provide an image which when reversed again in the transfer process of step (e) will result in the same image being reproduced on the base sheet. If a reversed final printed image is required, step (b) can be omitted.

In step (c) the reversed image is printed with either a photocopier if the image was assembled manually, or with a laser printer if a computer imaging technique is used. Preferably, a high resolution laser printer is used; the choice will depend on whether the image is in monochrome (also known as black and white), or is coloured. The following printers have been found to be suitable: for colour, Tektronix PHASER 560 (trade mark) and Tektronix PHASER 740 (trade mark), and for monochrome, Hewlett-Packard LASERJET-4M (trade mark) and Hewlett-Packard LASERJET-6P (trade mark).

The prepared and reversed image is printed onto the silicone coated surface of a release substrate, which is usually a paper material. The release paper desirably has as smooth a surface as possible, in order to obtain as good an image as possible for later transfer. A suitable release paper has been found to be the commercial product known as MACTAC (trade mark) STARLINER (trade mark). This material is commonly used as a carrier for self adhesive labels; other similar products are available.

If desired, the reversed printed image can also include registration marks for image alignment in the next step.

In step (d) the reversed printed image from step (c) is transferred onto the base sheet intended to receive it. The printed release sheet is entered between the two platens of a transfer press with the image correctly aligned into position, together with the base sheet onto which the image is to be transferred. In the press, one platen, usually the fixed lower one, is heated, and the other platen, usually the upper moveable one, is not heated. The release paper and the base sheet are arranged so that the toner image on the silicone release surface is in contact with the base sheet, and with the release paper adjacent the heated platen. It is highly desirable that the press platens be rugged enough to provide an effectively constant applied pressure over the entire surface of the release paper and the base sheet between which image transfer takes place in this step, bearing in mind that the pressures used in this step are relatively high, in the range of 400–500 kPa. It is also desirable to provide a layer of deformable material between the base sheet and the unheated platen, as this aids in obtaining good contact and a constant applied pressure between the release sheet surface and the base sheet over the surface of the base sheet, especially when the base sheet is one page of a passport or similar booklet. Such a layer will also serve to provide constant applied pressure to a base sheet having a level of surface irregularity, such as one including watermarks or raised printing. Where the base sheet is part of a booklet such as a passport it is preferred that the booklet be opened out, so that only the base sheet enters between the press platens. The choice of deformable material is quite wide. As the pressures involved are quite high, any material which will deform to some extent and thereby even out the applied pressure will suffice. In practise, both a thin elastomeric layer, and a layer of cardboard have been found satisfactory. Other suitable materials can easily be identified by simple experimentation.

The temperature of the heated platen depends on a number of factors.

In both a laser printer and a photocopier, the toner image is fused onto the paper by the application of heat. For the process of this invention, the same toner particles are subjected to two heating steps, in the initial printing in step (c) onto the silicone coated release surface of the release paper, and in the transfer in step (d) onto the surface of the base sheet. It is therefore necessary that the printing conditions in step (c) provide a stable image on the silicone surface of the release paper which is stable enough to be handled, but which also retains some latent fusing capability, so that in step (d) the toner particles transfer onto and fuse to the surface of the base sheet, to provide the desired fully fused toner image. It has been found that with most currently available toner materials, for both monochrome and colour printers, the wax component in the toner particles which provides fusing capability can be heated and cooled satisfactorily at least twice. If a toner is used which does not include a fusible wax component, some adjustment of the heaters in the printers may be found to be necessary. If the image on the base sheet is not fully fused onto the base sheet by the combination of time, temperature and pressure used in the press, image damage may result when the release paper and the base sheet are separated. Some experimentation may therefore be required to obtain the best temperature combinations between the laser printer and the press platens. It should also be noted that if the press temperature is too high, image damage can also happen. With the printers mentioned above, a platen temperature of about 95° C. appears to be sufficient for monochrome images, and of about 105–110° C. appears to be sufficient for coloured images.

The residence time in the heated press depends to some extent on the material used as the base sheet to receive the second level printing. A single sheet, such as an internal page of a passport, will typically require about 5 seconds. A thicker page, such as the inside face of the outside cover of a passport, will typically require about 10 seconds at the temperatures mentioned previously.

In step (f) the still warm document is removed from between the press platens, with the release paper adhering to the base sheet. After allowing enough time for the base sheet and release paper to cool to a temperature at which it an be handled, which is usually quite short, the release paper is peeled away from the base sheet, thus providing a visible image on the base sheet which is now the correct way around, as a second mirror image reversal takes place in the transfer step.

In a modification of this step, a press is used in which one platen can be both heated and cooled, so that the document can be both heated and cooled, for example at least to about 70° C., before removal from the press. It appears that cooling the combination of base sheet and silicone coated release paper at least somewhat in contact under pressure improves the quality of the transferred image. It is also then possible to include a suitable temperature sensing device in the press, so that it opens automatically when a desired preset temperature has been reached.

In the preceding description a two platen press is used. It has been found that although a twin roller press could be used, its use is not recommended. Although the required temperature and pressure can be obtained, it appears that without the flattening effect of the press platens adequate image transfer does not take place. It is observed that with a roll press, the release paper and the base sheet tend to curl away from each other before adequate toner transfer and adhesion to the base sheet has occurred. Consequently, adequate transfer of the toner image from the release paper onto the base sheet is not always obtained.

If desired, after completing the printing process, the face of the base sheet carrying the second level printing, or both faces of the base sheet, can be protected with a security laminate, using conventional laminating procedures and materials. Further, if desired, the printing process can be repeated to apply another image to the other side of the base sheet before the lamination is applied to the base sheet.

What is claimed is:

1. A transfer printing process for applying an image to a document base sheet including the following steps:

(a) assembling the image;

(b) converting the image into its mirror image;

(c) printing the mirror image onto a silicone coated surface of a release substrate by a laser printer or photocopier to provide a stable toner particle copy of the mirror image;

(d) combining the release substrate and the base sheet, with the toner particle copy of the mirror image in contact with the base sheet;

(e) applying sufficient heat and pressure to the combined release substrate and the base sheet to transfer the toner mirror image onto the base sheet by a twin platen single sheet press, having one unheated platen, and one platen constructed and arranged to be both heated and cooled, in which the base sheet is located adjacent the unheated platen; and (f) removing the release substrate to provide a base sheet carrying the image.

2. A process according to claim 1 wherein both image preparation and conversion in step (a) into its mirror image are carried out within a computer imaging system.

3. A process according to claim 1 wherein a laser printer is used in step (c).

4. A process according to claim 1 wherein the base sheet comprises one sheet of an existing document.

5. A process according to claim 1 wherein the base sheet comprises a sheet within a multi-page document.

6. A process according to claim 5 wherein the multi-page document is a passport.

7. A process according to claim 6 wherein the base sheet comprises the inside face of the cover of a passport.

8. A process according to claim 1 wherein in step (d) the applied pressure is from 400 kPa to 500 kPa.

9. A process according to claim 1 wherein in step (d) a deformable material is located in the press between the base sheet and the unheated platen.

10. A process according to claim 9 wherein the deformable material is chosen from the group consisting of an elastomeric layer and a deformable cardboard layer.

11. A process for applying an image to a document base sheet including the following steps:

(a) assembling the image;

(b) printing the image onto a silicone coated surface of a release substrate by a laser printer or photocopier to provide a stable toner particle copy of the image;

(c) combining the release substrate and the base sheet, with the toner particle copy of the image in contact with the base sheet;

(d) applying sufficient heat and pressure to the combined release substrate and the base sheet to transfer the toner image onto the base sheet by a twin platen single sheet press, having one unheated platen, and one platen constructed and arranged to be both heated and cooled, in which the base sheet is located adjacent the unheated platen; and (e) removing the release substrate to provide a base sheet carrying a mirror image of the image assembled in step (a).

* * * * *

UNITED STATES PATENT AND TRADEMARK OFFICE

CERTIFICATE OF CORRECTION

PATENT NO. : 6,432,602 B1
DATED : August 13, 2002
INVENTOR(S) : Van Beek, Gary A.

It is certified that error appears in the above-identified patent and that said Letters Patent is hereby corrected as shown below:

Column 3,
Line 18, delete “prister” and insert -- printer --.

Column 6,
Line 59, delete “unheated” and insert -- heated --.

Signed and Sealed this

Twenty-first Day of June, 2005

JON W. DUDAS
*Director of the United States Patent and Trademark Office*